US005462650A

United States Patent [19]

Takito et al.

[11] Patent Number: 5,462,650

[45] **Date of Patent: * Oct. 31, 1995**

[54] PROCESS FOR PRODUCING LOW VISCOSITY LUBRICATING BASE OIL HAVING HIGH VISCOSITY INDEX

[75] Inventors: Tetsuo Takito; Kazuki Inaba, both of Kanagawa; Yasuo Kinoshita, Okayama; Teruhiko Sasaki, Tokyo, all of Japan

[73] Assignee: Mitsubishi Oil Co., Ltd, Tokyo, Japan

[ * ] Notice: The portion of the term of this patent subsequent to Oct. 24, 2012, has been disclaimed.

[21] Appl. No.: 129,376

[22] Filed: Sep. 30, 1993

[30] Foreign Application Priority Data

Oct. 2, 1992 [JP] Japan ..... 4-287063

[51] Int. Cl.[6] ..... C10G 67/02

[52] U.S. Cl. ..... 208/58; 208/27; 208/96; 208/97

[58] Field of Search ..... 208/58, 96, 97, 208/27

[56] References Cited

U.S. PATENT DOCUMENTS

| | | | |
|---|---|---|---|
| 3,790,472 | 2/1974 | White | 208/58 |
| 3,794,580 | 2/1974 | Ladeur | 208/110 |
| 3,962,071 | 6/1976 | Itoh et al. | 208/58 |
| 4,347,121 | 8/1982 | Mayer et al. | 208/58 |
| 4,361,477 | 11/1982 | Miller | 208/58 |
| 4,747,932 | 5/1988 | Miller | 208/58 |
| 4,853,104 | 8/1989 | Degnan, Jr. et al. | 208/58 |
| 5,288,395 | 2/1994 | Marler et al. | 208/58 |

FOREIGN PATENT DOCUMENTS

| | | | |
|---|---|---|---|
| 0435670 | 7/1991 | European Pat. Off. . | |
| 46-3267 | 1/1971 | Japan . | |
| 57-17037 | 4/1982 | Japan | C10G 67/04 |
| WO-A-9102782 | 3/1991 | WIPO . | |

OTHER PUBLICATIONS

*Chemical Technology of Petroleum,* Gruge et al, 1960 p. 570.

*Primary Examiner*—Helane Myers

*Attorney, Agent, or Firm*—Sughrue, Mion, Zinn, Macpeak & Seas

[57] ABSTRACT

A process for the production of a high viscosity index, low viscosity lubricating base oil having a kinematic viscosity of 3.0 to 5.0 $mm^2/s$ at 100° C., a viscosity index of 120 or more and a pour point of −10° C. or less, while simultaneously producing a high quality fuel oil, which includes using at least one of a heavy gas oil fraction and a light vacuum gas oil fraction as a stock oil that contains about 60% by volmme or more of distillate components within a distillation temperature range of from about 370 to about 480° C. and about 50% by mass or more of saturated hydrocarbons, subjecting the stock oil to hydrocracking in the presence of an amorphous silica alumina catalyst, separating the cracked product into a fuel oil fraction and a lubricating oil fraction by atmospheric distillation, and subsequently subjecting the lubricating oil fraction to dewaxing, optionally applying at least one of solvent refining and hydrofinishing.

12 Claims, No Drawings

PROCESS FOR PRODUCING LOW VISCOSITY LUBRICATING BASE OIL HAVING HIGH VISCOSITY INDEX

FIELD OF THE INVENTION

This invention relates to a process for the production of a low viscosity lubricating base oil having a high viscosity index, together with a high quality fuel oil mainly composed of a middle distillate.

BACKGROUND OF THE INVENTION

In general, when a lubricating base oil is produced from crude oil, the crude oil is first subjected to atmospheric distillation, and the resulting residual oil is further subjected to vacuum distillation to separate various lubricating oil fractions having varied viscosities and vacuum distillation residual oil. The vacuum distillation residual oil is subjected to solvent deasphalting, thereby removing asphalt contents and obtaining a heavy lubricating oil fraction (bright stock). These lubricating oil fractions having varied viscosities, including the bright stock, are further subjected to solvent refining, hydrofinishing, dewaxing and the like steps to produce the lubricating base oil of interest.

On the other hand, a hydrocracking process is known as a process for the production of a lubricating base oil having a high viscosity index. In this process, heavy oils such as vacuum gas oil fraction, bright stock and the like are subjected to hydrocracking under high temperature and high pressure conditions in the presence of a catalyst, and a high viscosity index base oil is produced from the resulting oil.

Examples of the hydrocracking of heavy oil are disclosed, for instance, in JP-B-46-3267, JP-B-50-26561, JP-B-50-36442, JP-B-51-15046, JP-B-51-41641, JP-B-54-21205, JP-B-54-31002, JP-B-57-17912, JP-B-62-5958, JP-A-48-49804, JP-A- 63-258984, JP-A-64-6094, JP-A-3-197594, JP-A-3-223393 and the like. (The term "JP-B" as used herein means an "examined Japanese patent publication", and the term "JP-A" as used herein means an "unexamined published Japanese patent application".) Also, hydrocracking and isomerization of wax and the like as the stock oil are disclosed, for instance, in JP-B-57-17037, JP-B-60-22039, JP-A-50-92905, JP-A-51-146502, JP-A-52-136203, JP-A-1-223196, JP-A-1-301790, JP-B-4-503371, JP-A-4-226594, U.S. Pat. No. 4,547,283, U.S. Pat. No. 4,906,350, EP-A1-0464547 and the like.

Development of a low viscosity base oil having a high viscosity index has been called for in the area of not only engine oil but also hydraulic fluid for construction machine use.

However, production of a low viscosity lubricating base oil having a high viscosity index is not easy because, when it is produced by the solvent refining process in the art, the product is limited to certain lubricating oil fractions from specific high quality crude oil, and an extremely high extractant ratio is required in the solvent refining step.

Because of this, the aforementioned hydrocracking process has been developed and put into practical use only as a process for the production of low viscosity lubricating base oils having high viscosity index from mineral oil materials. However, since heavy oils such as vacuum gas oil fraction, bright stocks and the like are used as the stock oil in the hydrocracking process in the art, the viscosity index of the lubricating oil fraction produced by this process is high in the case of a distillate having a relatively high viscosity, but the index is not so high when the fraction has a relatively low viscosity of 3.0 to 5.0 $mm^2/s$ as a kinematic viscosity at 100° C.

In consequence, the hydrocracking process in the art aims at producing a lubricating base oil having a relatively high viscosity and, therefore, is not suitable for the production of a lubricating base oil having a relatively low viscosity and a high viscosity index.

SUMMARY OF THE INVENTION

This invention contemplates overcoming the aforementioned problems involved in the hydrocracking process in the art. It is accordingly, an object of the present invention to provide a process for the production of a low viscosity lubricating base oil having a high viscosity index, which has a relatively low kinematic viscosity of 3.0 to 5.0 $mm^2/s$ at 100° C., a high viscosity index of 120 or more and a pour point of −10° C. or less, while simultaneously producing a high quality fuel oil mainly composed of a middle distillate.

Other objects and advantages of the present invention will be made apparent as the description progresses.

With the aim of achieving the aforementioned objects, the inventors of the present invention have conducted intensive studies and found that a lubricating oil fraction can be obtained together with a high quality fuel oil consisting mainly of a middle distillate by (a) using at least one of a heavy gas oil fraction and a light vacuum gas oil fraction as a stock oil which contains about 60% by volume or more of distillate components within a distillation temperature range of from about 370° to about 480° C. as well as about 50% by mass or more of saturated hydrocarbons, (b) subjecting the stock oil to a hydrocracking treatment in the presence of a hydrocracking catalyst to obtain a cracked product, and (c) subsequently subjecting the cracked product to an atmospheric distillation treatment, and that a low viscosity base oil having a high viscosity index, which has a kinematic viscosity of 3.0 to 5.0 $mm^2/s$ at 100° C., a viscosity index of 120 or more and a pour point of −10° C. or less, can be obtained by subjecting the lubricating oil fraction to a dewaxing treatment, to which at least one of a solvent refining treatment and a hydrofinishing treatment is optionally applied.

In particular, the present inventors have discovered a process for producing a low viscosity lubricating base oil having a high viscosity index which comprises:

(A) effecting hydrocracking of a stock oil of at least one of a heavy gas oil fraction and a light vacuum gas oil fraction, the stock oil containing about 60% by volume or more of distillate components within a distillation temperature range of from about 370° to about 480° C. and about 50% by mass or more of saturated hydrocarbons, in the presence of a hydrocracking catalyst comprising an amorphous silica alumina carrier which contains at least one of the group VIb metals in the periodic table and at least one of the group VIII metals in the periodic table to obtain a cracked product;

(B) separating the cracked product into a fuel oil fraction and a lubricating oil fraction by atmospheric distillation, thereby producing a high quality fuel oil; and (C) subsequently subjecting the lubricating oil fraction to a dewaxing treatment, to which at least one of a solvent refining treatment and a hydrofinishing treatment is optionally applied, thereby producing a low viscosity lubricating base oil having a high viscosity index, which has a kinematic viscosity of about 3.0 to about 5.0 $mm^2/s$ at 100° C., a viscosity index of 120 or more and a pour point of −10° C. or less.

DETAILED DESCRIPTION OF THE INVENTION

The present invention will now be described in greater detail.

In the present invention, the saturated hydrocarbon content is a value measured in accordance with a liquid chromatographic technique, namely the IP method (IP368-84).

Of the heavy gas oil fraction and/or light vacuum gas oil fraction, a fraction having a relatively low distillation temperature is desirable for the production of a low viscosity base oil having a high viscosity index, because such a fraction contains smaller amounts of aromatic compounds and polycyclic naphthene compounds which have low viscosity indexes. In the hydrocracking step, the low viscosity index aromatic compounds contained in a stock oil are converted into monocyclic aromatic compounds, naphthene compounds and paraffin compounds having high viscosity indexes, while the polycyclic naphthene compounds are converted into monocyclic naphthene compounds and paraffin compounds, thereby improving the viscosity index. As described above, preferred stock oil may contain smaller amounts of high boiling point compounds having low viscosity indexes. In other words, the stock oil may have a viscosity index as high as possible, preferably about 85 or more.

The hydrocracking catalyst to be used in the present invention is a catalyst made of an amorphous silica alumina as a carrier which contains at least one of the group VIb metals such as molybdenum, tungsten and the like in an amount of from about 5 to about 30% by mass, and at least one of the group VIII metals such as cobalt, nickel and the like in an amount of from about 0.2 to about 10% by mass. This hydrocracking catalyst has both hydrogenation and cracking functions and therefore is suitable for use in the production of a lubricating base oil having a high viscosity index with a high middle distillate yield.

The hydrocracking reaction may be carried out under a hydrogen partial pressure of about 100 to about 140 kg/cm$^2$G, at an average reaction temperature of about 360° to about 430° C., at an LHSV value of about 0.3 to about 1.5 hr$^{-1}$, at a hydrogen/oil ratio of about 5,000 to about 14,000 scf/bbl and at a cracking ratio of about 40 to about 90% by volume, preferably under a hydrogen partial pressure of about 105 to about 130 kg/cm$^2$G, at an average reaction temperature of about 380° to about 425° C., at an LHSV value of about 0.4 to about 1.0 hr$^{-1}$ and at a cracking ratio of about 45 to about 90% by volume. The cracking ratio is defined as "100 - (% by volume of upper 360° C. fraction in the formed product)". While the cracking ratio can be less than about 40% by volume, if it is less than about 40% by volume, sufficient hydrocracking of the low viscosity index aromatic compounds and polycyclic naphthene compounds contained in the stock oil cannot generally be carried out, and therefore a low viscosity oil having a viscosity index of 120 or more (3.0 to 5.0 mm$^2$/s as a kinematic viscosity at 100° C.) is hardly obtainable. Also, while the cracking ratio can be higher than about 90% by volume, the yield of the lubricating oil fraction becomes low when the cracking ratio exceeds about 90% by volume.

After the hydrocracking step is carried out, the resulting oil is separated into a fuel oil fraction and a lubricating oil fraction by atmospheric distillation. In the fuel oil fraction thus obtained, desulfurization and denitrification are completed sufficiently, as well as hydrogenation of aromatic compounds. Each fraction of the fuel oil fraction can be used as a high quality fuel oil, because its naphtha fraction has a high isoparaffin content, its kerosene fraction has a high smoke point and its gas oil fraction has a high cetane number.

On the other hand, a portion of the lubricating oil fraction may be recycled to the hydrocracking step, or it may be further subjected to a vacuum distillation step to separate a lubricating oil fraction having a desired kinematic viscosity. The vacuum distillation separation may be carried out after a dewaxing step. Dewaxing treatment of the vacuum gas oil fraction is carried out to obtain a lubricating base oil having a desired pour point. The dewaxing treatment may be carried out in a usual way, such as solvent dewaxing, catalytic dewaxing or the like process.

In the solvent dewaxing step, an MEK/toluene mixture is generally used as a solvent, but benzene, acetone, MIBK or the like solvent may also be used. The solvent dewaxing may be carried out at a solvent/oil ratio of 1 to 6 times and at a filtration temperature of about −15° to about −40° C., in order to set the pour point of the dewaxed oil to −10° C. or below. In this instance, the slack wax byproduct can be reused in the hydrocracking step.

According to the present invention, a solvent refining treatment and/or a hydrofinishing treatment may be applied to the dewaxing step. These application treatments are carried out in order to improve UV stability and oxidation stability of the lubricating base oil, which may be effected by conventionally used means in the general lubricating oil refining step. That is, the solvent refining may be carried out generally using furfural, phenol, N-methylpyrrolidone or the like as a solvent to remove aromatic compounds, especially polycyclic aromatic compounds, which remain in a small quantity in the lubricating oil fraction. In the case of furfural refining by a rotary-disc countercurrent contact extraction apparatus, extraction is carried out by setting a temperature gradient in the extraction column at such a gradient tha-t.about 0.5 to about 6 volume parts of furfural can contact with 1 volume part of the stock oil counter-currently in the extraction column. In general, the extraction temperature at the top of the extraction column is about 60° to about 150° C. and the temperature at the bottom is lower than the column top temperature by about 20° to about 100° C.

The hydrofinishing is carried out in order to hydrogenate olefin compounds and aromatic compounds. Though the catalyst is not particularly limited, the hydrofinishing may be carried out using an alumina catalyst containing at least one of the group VIb metals such as molybdenum and the like and at least one of the group VIII metals such as cobalt, nickel and the like, under a reaction pressure (partial pressure of hydrogen) of about 70 to about 160 kg/cm$^2$G, at an average reaction temperature of about 300° to about 390° C. and at an LHSV value of about 0.5 to about 4.0 hr$^{-1}$.

The following examples are provided to further illustrate the present invention. It is to be understood, however, that the examples are for purpose of illustration only and are not to be construed to limit the scope of the invention. Unless otherwise indicated, all parts, percents, ratios and the like are by weight.

EXAMPLE 1

Using a heavy gas oil fraction shown in Table 1 as a stock oil, hydrocracking was carried out under a hydrogen partial pressure of 110 kg/cm$^2$G, at an average reaction temperature of 408° C., at an LHSV value of 0.69 hr$^{-1}$ and at a hydrogen/oil ratio of 9,000 scf/bbl, in the presence of a sulfurized form of catalyst which was prepared by supporting 3% by mass of nickel and 15% by mass of molybdenum on an amorphous silica alumina carrier having a silica/alumina ratio of 10/90.

By subjecting the cracked product to atmospheric distillation, 15% by volume of a naphtha fraction, 16% by volume of a kerosene fraction, 51% by volume of a gas oil fraction and 24% by volume of a lubricating oil fraction, based on the stock oil, were obtained. The cracking ratio was found to be 73% by volume. The smoke point of the kerosene and cetane index of the gas oil were found to be 22 and 54, respectively.

Next, the lubricating oil fraction was subjected to solvent dewaxing using an MEK/toluene mixture solvent at a solvent/oil ratio of 4 times and at a filtration temperature of −21° C. The dewaxing yield was found to be 79% by volume.

When the thus dewaxed oil was subjected to vacuum distillation, a lubricating base oil having a kinematic viscosity of 3.94 $mm^2/s$ at 100° C. was obtained with a yield of 65% by volume based on the dewaxed oil. The thus obtained lubricating base oil showed a viscosity index of 129 and a pour point of −15° C.

EXAMPLE 2

Using the same stock oil and catalyst used in Example 1, hydrocracking was carried out under a hydrogen.partial pressure of 110 $kg/cm^2G$, at an average reaction temperature of 397° C., at an LHSV value of 0.69 $hr^{-1}$ and at a hydrogen/oil ratio of 9,000 scf/bbl.

By subjecting the cracked product to atmospheric distillation, 8% by volume of a naphtha fraction, 6% by volume of a kerosene fraction, 42% by volume of a gas oil fraction and 51% by volume of a lubricating oil fraction, based on the stock oil, were obtained. The cracking ratio was found to be 46% by volume. The smoke point of the kerosene and cetane index of the gas oil were found to be 22 and 54, respectively.

Next, the lubricating oil fraction was subjected to solvent dewaxing in the same manner as described in Example 1. The dewaxing yield was found to be 78% by volume.

When the thus dewaxed oil was subjected to vacuum distillation, a lubricating base oil having a kinematic viscosity of 4.01 $mm^2/s$ at 100° C. was obtained with a yield of 75% by volume based on the dewaxed oil. The thus obtained lubricating base oil showed a viscosity index of 122 and a pour point of −15° C.

EXAAMPLE 3

The lubricating oil fraction from the product of hydrocracking described in Example 1 was subjected to vacuum distillation to obtain a distillate having a kinematic viscosity of 3.91 $mm^2/s$ at 100° C. with a yield of 65% by volume based on the lubricating oil fraction. The thus obtained distillate was subjected to furfural solvent refining by a rotary-disc counter-current contact extraction apparatus using 2 volume parts of furfural based on 1 volume part of the stock oil and at extraction temperatures of 120° C. at the extraction column top and 52° C. at the column bottom. The raffinate thus obtained with a yield of 98% by volume was subjected to hydrofinishing. Hydrofinishing was carried out under a hydrogen partial pressure of 105 $kg/cm^2G$, at an LHSV value of 2.5 $hr^{-1}$ and at an average reaction temperature of 330° C. in the presence of an alumina catalyst on which cobalt and molybdenum were supported. The oil thus formed with a yield of 99% by volume was subjected to dewaxing under the same conditions described in Example 1.

The lubricating base oil thus formed by these treatments showed a kinematic viscosity of 4.00 $mm^2/s$ at 100° C., a viscosity index of 129 and a pour point of −15° C.

When this base oil was subjected to a UV stability test, turbidity was not found in the oil for a period of 50 hours or more, and precipitation did not occur for 50 hours or more, thus confirming the excellent UV stability of the base oil. In this connection, when a UV stability test of the lubricating base oil obtained in Example 1 was carried out without subjecting it to the furfural refining and hydrofinishing treatments, the period for the generation of turbidity was found to be 10 hours, and the period for the generation of precipitation was found to be 20 hours.

COMPARATIVE EXAMPLE

Using a vacuum gas oil fraction shown in Table 1 as a stock oil (fraction having a boiling point range of 370° to 480° C., 47% by volume; saturated hydrocarbons, 51% by mass), hydrocracking was carried out using the same catalyst and under the same reaction conditions employed in Example 1. By subjecting the cracked product to atmospheric distillation, 31.1% by volume of a lubricating oil fraction was obtained. The cracking ratio was found to be 66.0% by volume.

Next, the lubricating oil fraction was subjected to dewaxing in the same manner as described in Example 1. The dewaxing yield was found to be 68.9% by volume.

When the thus dewaxed oil was subjected to vacuum distillation, a lubricating base oil having a kinematic viscosity of 3.99 $mm^2/s$ at 100° C. was obtained with a yield of 55% by volume based on the dewaxed oil. This lubricating base oil showed a pour point of −15° C., but it had a low viscosity index of 114.

TABLE 1

Properties Of Stock Oil

| Stock oil | Heavy gas oil fraction | Vacuum gas oil fraction |
|---|---|---|
| Density ($g/cm^3$, at 15° C.) | 0.891 | 0.919 |
| Kinematic viscosity, ($mm^2/s$, at 100° C.) | 3.94 | 6.86 |
| Viscosity index | 95 | 84 |
| Saturated hydrocarbons, (% by mass, measured by IP368-84) | 60 | 48 |
| Distillation characteristics, (°C., measured by ASTM D2887) | | |
| IBP | 242 | 255 |
| 10% | 336 | 353 |
| 20% | 364 | 387 |
| 30% | 381 | 410 |
| 40% | 393 | 429 |
| 50% | 405 | 446 |
| 60% | 415 | 463 |
| 70% | 426 | 481 |
| 80% | 439 | 501 |
| 90% | 459 | 525 |
| EP | 530 | 584 |

Thus, as is evident from these results, a low viscosity lubricating base oil having a high viscosity index, which has a relatively low kinematic viscosity of 3.0 to 5.0 $mm^2/s$ at 100° C., a high viscosity index of 120 or more and a pour point of −10° C. or less, can be produced by the process of the present invention, while a high quality fuel oil mainly composed of a middle distillate is simultaneously produced.

While the invention has been described in detail and with reference to specific embodiments thereof, it will be apparent to one skilled in the art that various changes and modifications can be made therein without departing from the spirit and scope thereof.

What is claimed is:

1. A process for producing a lubricating base oil which has a kinematic viscosity of 3.0 to 5.0 $mm^2/s$ at 100° C., a viscosity index of 120 or more and a pour point of −10° C. or less, said process comprising:

(A) effecting hydrocracking of a stock oil of at least one of a heavy gas oil fraction and a light vacuum gas oil fraction, the stock oil containing about 60% by volume or more of distillate components within a distillation temperature range of from about 370° to about 480° C. and about 50% by mass or more of saturated hydrocarbons, in the presence of a hydrocracking catalyst comprising an amorphous silica alumina carrier which contains at least one of the group VIb metals in the periodic table and at least one of the group VIII metals in the periodic table to obtain a cracked product;

(B) separating the cracked product into a fuel oil fraction and a lubricating oil fraction by atmospheric distillation, thereby producing a high quality fuel oil; and (C) subsequently subjecting the lubricating oil fraction to a dewaxing treatment, to which at least one of a solvent refining treatment and a hydrofinishing treatment is optionally applied, thereby producing a lubricating base oil which has a kinematic viscosity of about 3.0 to about 5.0 $mm^2/s$ at 100° C., a viscosity index of 120 or more and a pour point of −10° C. or less.

2. A process according to claim 1, wherein said hydrocracking is carried out under a hydrogen partial pressure of about 100 to about 140 $kg/cm^2G$, at an average reaction temperature of about 360° to about 430° C., at an LHSV value of about 0.3 to about 1.5 $hr^{-1}$ and at a cracking ratio of about 40 to about 90% by volume, in the presence of a hydrocracking catalyst containing molybdenum in an amount of from about 5 to about 30% by mass and nickel in an amount of from about 0.2 to about 10% by mass.

3. A process according to claim 1, wherein after the step of separating the cracked product into a fuel oil fraction and a lubricating oil fraction by atmospheric distillation, a lubricating base oil is produced by subjecting said lubricating oil fraction to vacuum distillation.

4. A process according to claim 2, wherein after the step of separating the cracked product into a fuel oil fraction and a lubricating oil fraction by atmospheric distillation, a lubricating base oil is produced by subjecting said lubricating oil fraction to vacuum distillation.

5. A process according to claim 2, wherein said hydrocracking is carried out under a hydrogen partial pressure of about 105 to about 130 $kg/cm^2G$, at an average reaction temperature of about 380° to 425° C., at an LHSV value of about 0.4 to about 1.0 $hr^{-1}$ and at a cracking ratio of about 45 to about 90% by volume.

6. A process according to claim 5, wherein after the step of separating the cracked product into a fuel oil fraction and a lubricating oil fraction by atmospheric distillation, a lubricating base oil is produced by subjecting said lubricating oil fraction to vacuum distillation.

7. A process according to claim 1, wherein the stock oil has a viscosity index of at least about 85.

8. A process according to claim 2, wherein the stock oil has a viscosity index of at least about 85.

9. A process according to claim 3, wherein the stock oil has a viscosity index of at least about 85.

10. A process according to claim 4, wherein the stock oil has a viscosity index of at least about 85.

11. A process according to claim 5, wherein the stock oil has a viscosity index of at least about 85.

12. A process according to claim 6, wherein the stock oil has a viscosity index of at least about 85.

* * * * *